US011724841B2

(12) United States Patent
Hu

(10) Patent No.: US 11,724,841 B2
(45) Date of Patent: Aug. 15, 2023

(54) MACHINE HEAD FOR PACKING MACHINE AND PACKING MACHINE

(71) Applicant: QINGDAO SACPACK INTELLIGENT EQUIPMENT CO., LTD., Qingdao (CN)

(72) Inventor: Xiangrong Hu, Qingdao (CN)

(73) Assignee: QINGDAO SACPACK INTELLIGENT EQUIPMENT CO., LTD., Qingdao (CN)

( * ) Notice: Subject to any disclaimer, the term of this patent is extended or adjusted under 35 U.S.C. 154(b) by 0 days.

(21) Appl. No.: 17/915,142

(22) PCT Filed: Jul. 16, 2020

(86) PCT No.: PCT/CN2020/102228
§ 371 (c)(1),
(2) Date: Sep. 28, 2022

(87) PCT Pub. No.: WO2021/208281
PCT Pub. Date: Oct. 21, 2021

(65) Prior Publication Data

US 2023/0182941 A1 Jun. 15, 2023

(30) Foreign Application Priority Data

Apr. 13, 2020 (CN) ..... 202010284678.2

(51) Int. Cl.
*B65B 13/18* (2006.01)
*B65B 13/22* (2006.01)
(Continued)

(52) U.S. Cl.
CPC ..... *B65B 13/06* (2013.01); *B65B 13/16* (2013.01); *B65B 13/187* (2013.01); *B65B 13/22* (2013.01); *B65B 13/32* (2013.01)

(58) Field of Classification Search
CPC ..... B65B 13/04; B65B 13/06; B65B 13/16; B65B 13/187; B65B 13/22; B65B 13/32
(Continued)

(56) References Cited

U.S. PATENT DOCUMENTS 5,613,432 A * 3/1997 Hoshino ..... B65B 13/06 53/589
6,109,325 A 8/2000 Chang

FOREIGN PATENT DOCUMENTS

BE 826519 A 9/1975
CN 1421357 A 6/2003
(Continued)

*Primary Examiner* — Jimmy T Nguyen
(74) *Attorney, Agent, or Firm* — Standley Law Group LLP; Adam Smith

(57) ABSTRACT

A strapping machine and head are provided including a mounting base, a sealing assembly including a cutter for cutting the strapping tape and a sealing element for welding a strapping tape. The sealing assembly, which is slidably disposed on the mounting base, includes a first, second, and a third clamping mechanism, for clamping the strapping tape. A belt feeding assembly including a first motor, a driving wheel and a guide block fixedly disposed on the mounting base. The driving wheel rotatably disposed on the mounting base and an arc-shaped belt feeding channel is formed between the driving wheel and the guide block. The first motor drives the driving wheel to rotate, and a driving assembly drives the sealing assembly close to or away from the driving wheel. A balanced tension is applied to a strapping tape through a strapping machine head to improve the strapping quality of the strapping machine.

6 Claims, 9 Drawing Sheets

(51) Int. Cl.
*B65B 13/32* (2006.01)
*B65B 13/06* (2006.01)
*B65B 13/16* (2006.01)

(58) Field of Classification Search
USPC ..... 100/26, 29, 32
See application file for complete search history.

(56) References Cited

FOREIGN PATENT DOCUMENTS

| | | | | | |
|---|---|---|---|---|---|
| CN | 101778771 | A | | 7/2010 | |
| CN | 103057736 | A | | 4/2013 | |
| CN | 104507813 | A | | 4/2015 | |
| CN | 207450337 | U | | 6/2018 | |
| CN | 111392093 | A | | 7/2020 | |
| DE | 102014103332 | A1 | * | 9/2015 | ..... B65B 13/06 |
| JP | 2009161207 | A | * | 7/2009 | ..... B65B 13/06 |

* cited by examiner

MACHINE HEAD FOR PACKING MACHINE AND PACKING MACHINE

CROSS-REFERENCE TO RELATED APPLICATIONS

This application claims priority to International Application No. PCT/CN2020/102228, filed on Jul. 16, 2020, which claims the priority benefit of China Patent Application No. 202010284678.2, filed on Apr. 13, 2020, the contents of the above identified applications are incorporated herein by reference in their entirety.

TECHNICAL FIELD

The present invention relates to the technical field of strapping machines, in particular to a head for a strapping machine and a strapping machine.

BACKGROUND ART

Currently, with the continuous development of the logistics industry, goods are often required to be baled with a strapping tape before being transported. With the popularization of automatic baling technology, baling machines with automated baling capabilities are widely used. For example: Chinese Patent Nos. 02140955.2 and 200880103087.8 respectively disclose a strapping machine (bundling machine), which mainly uses a strapping tape to wrap goods. Components such as a strapping head, a strapping chute, and a strapping material dispenser are commonly provided in such strapping machines, wherein the strapping head has the ability to guide strapping material (such as a strapping tape) into and out of the strapping chute and to be able to grasp, tighten, cut and weld the strapping material. For strapping head, it usually includes a tensioning assembly and a sealing assembly, in actual use, the tensioning assembly is configured with tensioning jaws to draw and apply a tensioning force to the strapping material, while the sealing assembly welds and cuts the strapping material primarily through the sealing element and cutter. Also, for both the tensioning assembly and the sealing assembly, each can be moved relative to one another on a slide rail on the strapping head to affect the strapping to complete the strapping operation. However, in the actual use process, because the tensioning assembly and the sealing assembly slide relatively along the slide rail under the influence of the driving assembly, the tensioning assembly and the sealing assembly will float irregularly on the slide rail when the strapping material is tensioned against the reaction force of the strapping material, where the strapping material has been tightened against the goods, which results in uneven forces on the strapping tape on the different sides, on the one hand, increased quality requirements for baling materials will result in increased strapping costs, on the other hand, strapping tightness of the goods is not uniform, and the strapping quality is reduced.

Therefore, how to design a baling technology with good strapping quality and low quality requirements for baling materials to reduce strapping costs is the technical problem to be solved by the present invention.

DISCLOSURE OF THE INVENTION

The present invention provides a head for a strapping machine and a strapping machine for increasing the strapping quality of the strapping machine by applying a balanced tension to a strapping tape through a strapping machine head.

The present invention provides a head for a strapping machine, comprising:

a mounting base;

a sealing assembly including a cutter and a sealing element, the sealing element is used for welding a strapping tape, and the cutter is used for cutting the strapping tape; the sealing assembly further comprises a first clamping mechanism, a second clamping mechanism and a third clamping mechanism, the first clamping mechanism, the second clamping mechanism and the third clamping mechanism are used for clamping the strapping tape; the sealing assembly is slidably disposed on the mounting base;

a belt feeding assembly including a first motor, a driving wheel and a guide block, the guiding block is fixedly disposed on the mounting base, and the driving wheel is rotatably disposed on the mounting base and an arc-shaped belt feeding channel is formed between the driving wheel and the guide block, the first motor is used to drive the driving wheel to rotate;

a driving assembly for driving the sealing assembly close to or away from the driving wheel;

wherein, the strapping tape first passes through the first clamping mechanism into the sealing assembly via the belt feeding channel, and the strapping tape is sequentially passing through the second clamping mechanism, the cutter, the sealing element and the third clamping mechanism.

Further, the sealing assembly comprises a housing, a top portion of the housing is provided with an inlet belt lead-in portion and an outlet belt lead-out portion, the first clamping mechanism is located between the inlet belt lead-in portion and the outlet belt lead-out portion, and the outlet belt lead-out portion is disposed opposite the inlet port of the feeding channel.

Further, the inlet of the belt feeding channel is provided with an abutment portion for inserting the outlet belt lead-out portion, and the abutment portion has a bell mouth structure.

Further, a rotating shaft is disposed in the housing, a first cam, a second cam and a third cam are disposed on the rotating shaft, and a second motor is disposed on the housing, and the second motor is drivingly connected to the rotating shaft;

the first clamping mechanism includes a first fixed block, a first sliding block and a first return spring disposed oppositely, the first fixed block is fixedly disposed in the housing, the first sliding block is slidably disposed in the housing and in contact with the first cam, the first return spring is used to apply an elastic force on the first sliding block that moves toward the first cam direction;

the second clamping mechanism includes a second fixed block, a second sliding block and a second return spring arranged oppositely, the second fixed block is fixedly disposed in the housing, the second sliding block is slidably disposed in the housing and in contact with the second cam, the second return spring is used to apply an elastic force on the second sliding block that moves toward the second cam direction;

the third clamping mechanism includes a third fixed block, a third sliding block and a third return spring arranged oppositely, the third fixed block is fixedly disposed in the housing, the third sliding block is slidably disposed in the housing and in contact with the third cam, the third return spring is used to apply an elastic force on the third sliding block that moves toward the third cam direction.

Further, the first clamping mechanism comprises a first telescopic mechanism provided in the housing and two oppositely arranged first clamping blocks, the first telescopic mechanism is used to drive the two first clamping blocks toward and away from each other; the second clamping mechanism comprises a second telescopic mechanism provided in the housing and two oppositely arranged second clamping blocks, the second telescopic mechanism is used to drive the two second clamping blocks toward and away from each other; the third clamping mechanism comprises a third telescopic mechanism provided in the housing and two oppositely arranged third clamping blocks, the third telescopic mechanism is used to drive the two third clamping blocks toward and away from each other.

Further, the guide block includes an upper guide block and a lower guide block, the upper guide block and the lower guide block are each fixedly mounted on the mounting base, and surfaces of the upper guide block and the lower guide block that cooperate with the driving wheel are each arcuate surface.

Further, a spacing region is formed between the upper guide block and the lower guide block; the belt feeding assembly further comprises a pressing assembly, the pressing assembly comprises a wheel base, a pressing wheel and a pressing spring, an end of the wheel base is rotatably mounted on the mounting base, the pressing spring is used to apply an elastic force to the wheel base that rotates in the direction of the driving wheel, the pressing wheel is rotatably disposed on the wheel base, and the pressing wheel is located in the spacing region and against the driving wheel.

Further, a guide rail is provided on the mounting base, a reciprocating sliding carriage is provided on the guide rail, the sealing assembly is disposed on the sliding carriage.

Further, the driving assembly is an electric push cylinder, a push rod of the electric push cylinder is connected to the sealing assembly; alternatively, the driving assembly includes a first drive motor, a gear and a rack, the gear is rotatably disposed on the mounting base, the rack is slidably mounted on the mounting base, the gear is cooperated with the rack, the first drive motor is drivingly connected to the gear, the rack is connected to the sealing assembly; alternatively, the driving assembly includes a second drive motor, a screw and a nut, the nut is threadedly connected to the screw, the second drive motor is drivingly connected to the screw, the nut is connected to the sealing assembly.

The present invention also provides a strapping machine comprising the head for a strapping machine described above.

The present invention provides a head for a strapping machine and a strapping machine, by arranging three clamping mechanisms on a sealing assembly, the belt feeding assembly drives the strapping tape to bypass the goods, and then clamps the strapping tape by the corresponding clamping mechanisms, the driving assembly only needs to drive the sealing assembly to move to complete a tightening of the strapping tape, the sealing assembly guides the strapping tape through a driving wheel of the belt feeding assembly, so that two ends of the strapping tape are balanced at all times, thereby ensuring that two ends of the strapping tape are balanced at all times to reduce the requirement of the strapping tape quality, achieving a good bailing effect, while making strapping tightness of the goods uniform, to improve the strapping quality.

DETAILED DESCRIPTION

Figure 1:
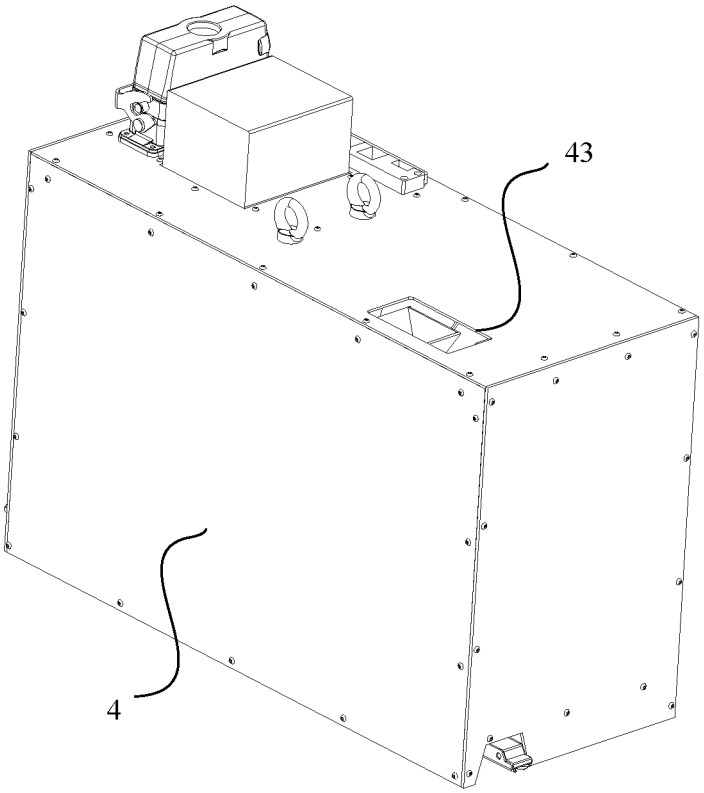
FIG. 1 is a schematic structural view of a strapping machine head of the present invention.
Figure 2:
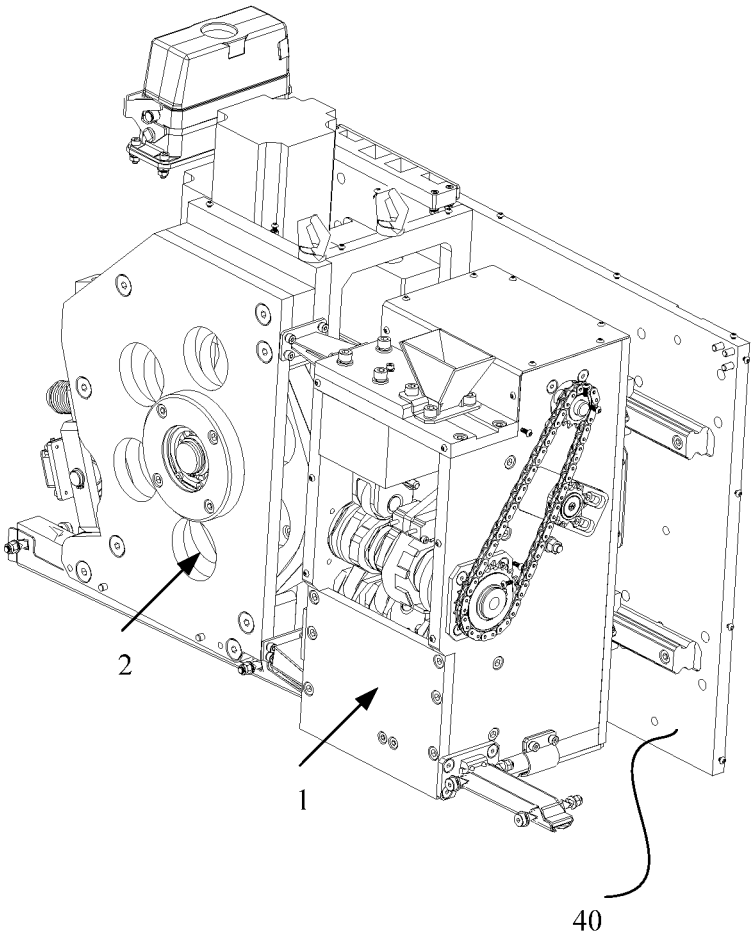
FIG. 2 is a partial structural schematic view of a strapping machine head of the present invention.
Figure 3:
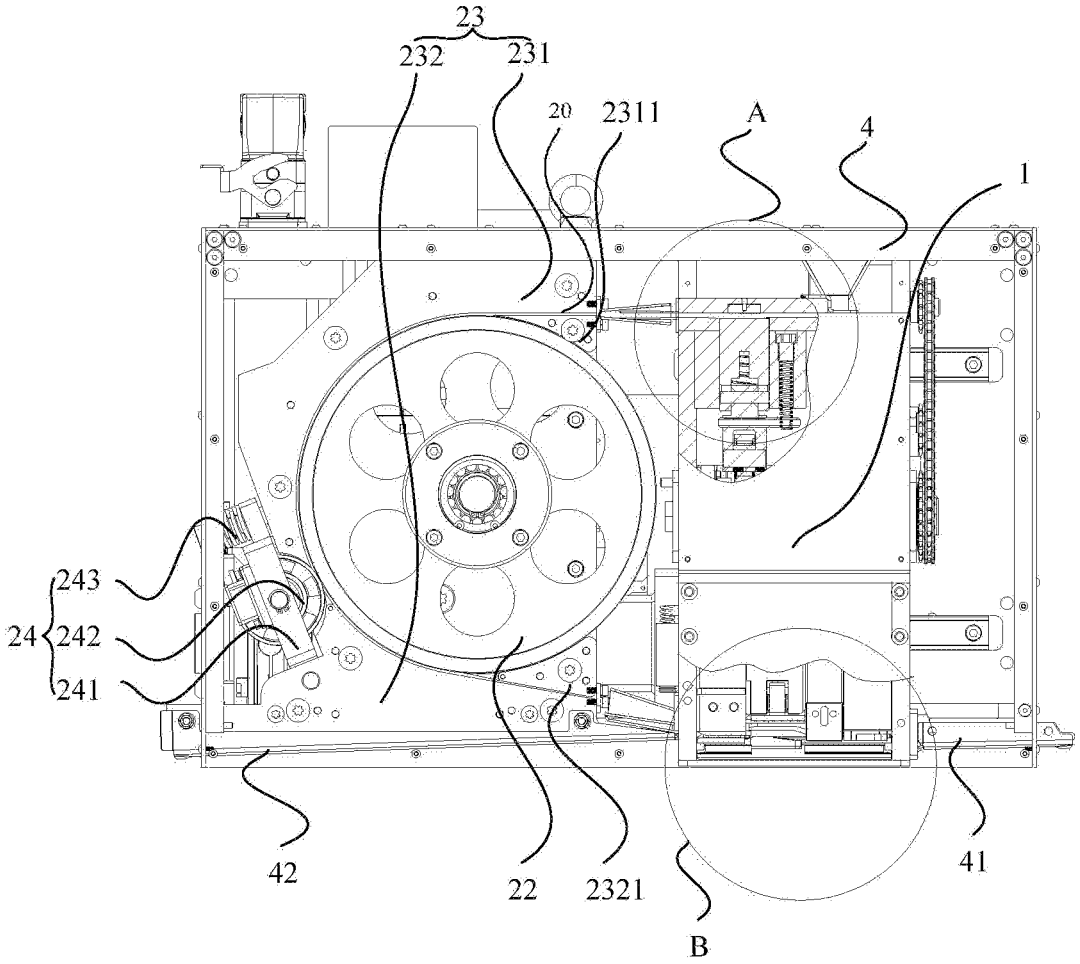
FIG. 3 is a schematic structural view showing the front panel of the housing removed from a strapping machine head.
Figure 4:
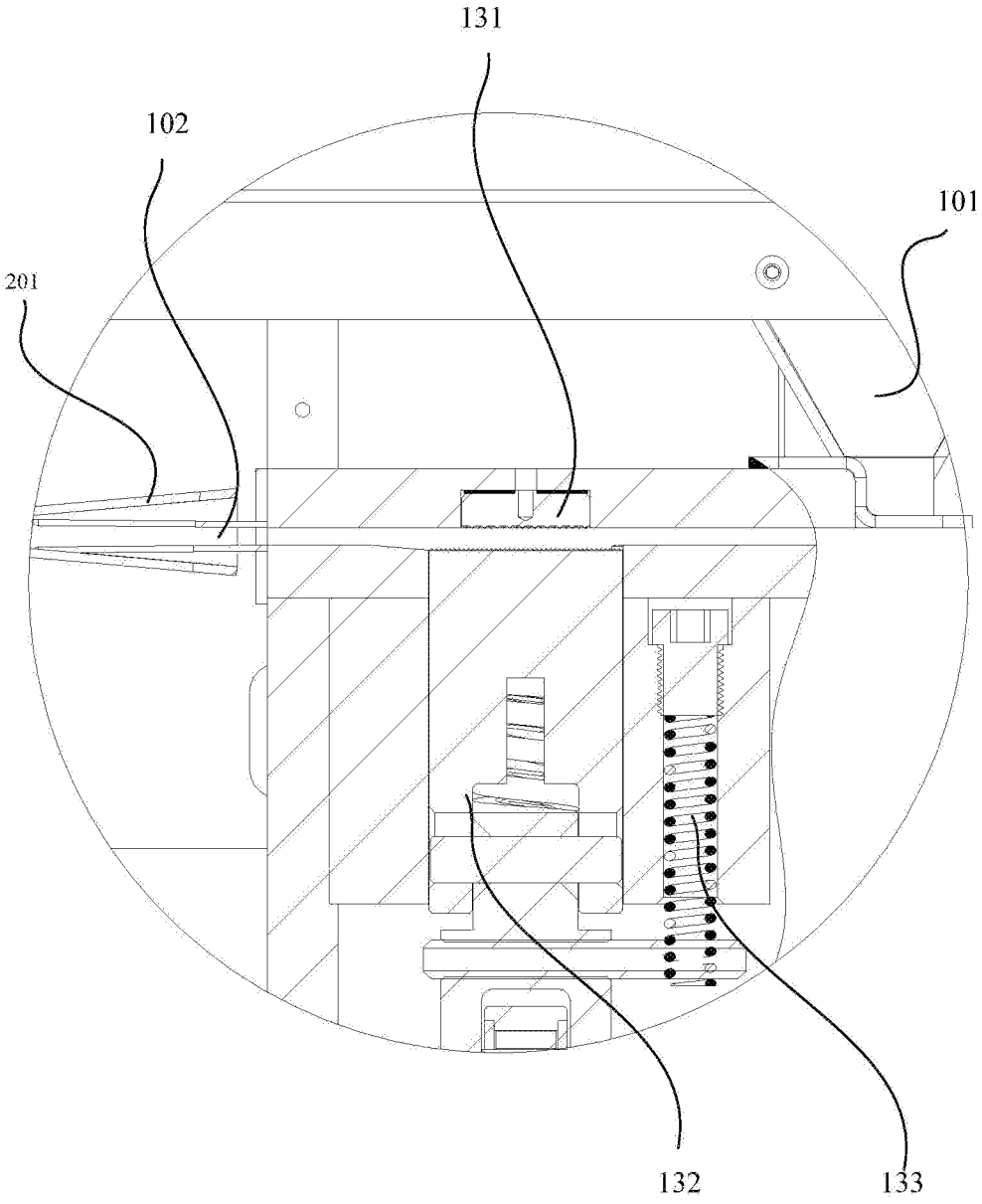
FIG. 4 is an enlarged fragmentary view of area A of FIG. 3.
Figure 5:
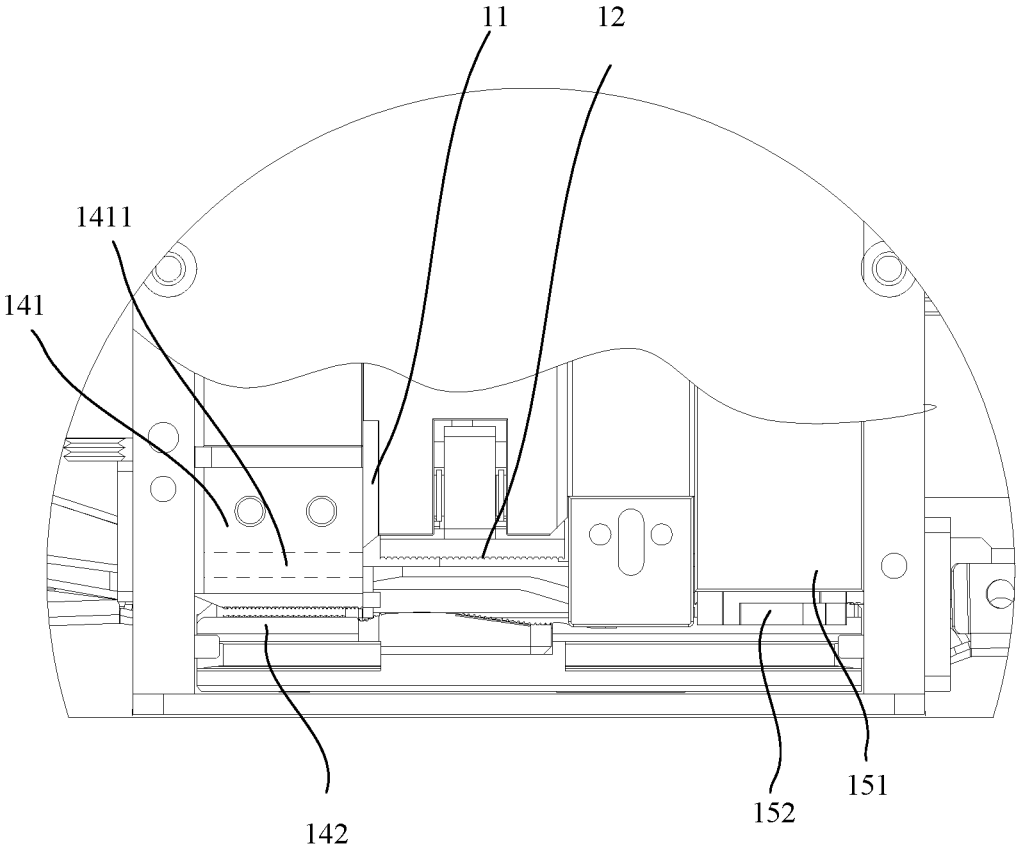
FIG. 5 is an enlarged fragmentary view of area B in FIG. 3.
Figure 6:
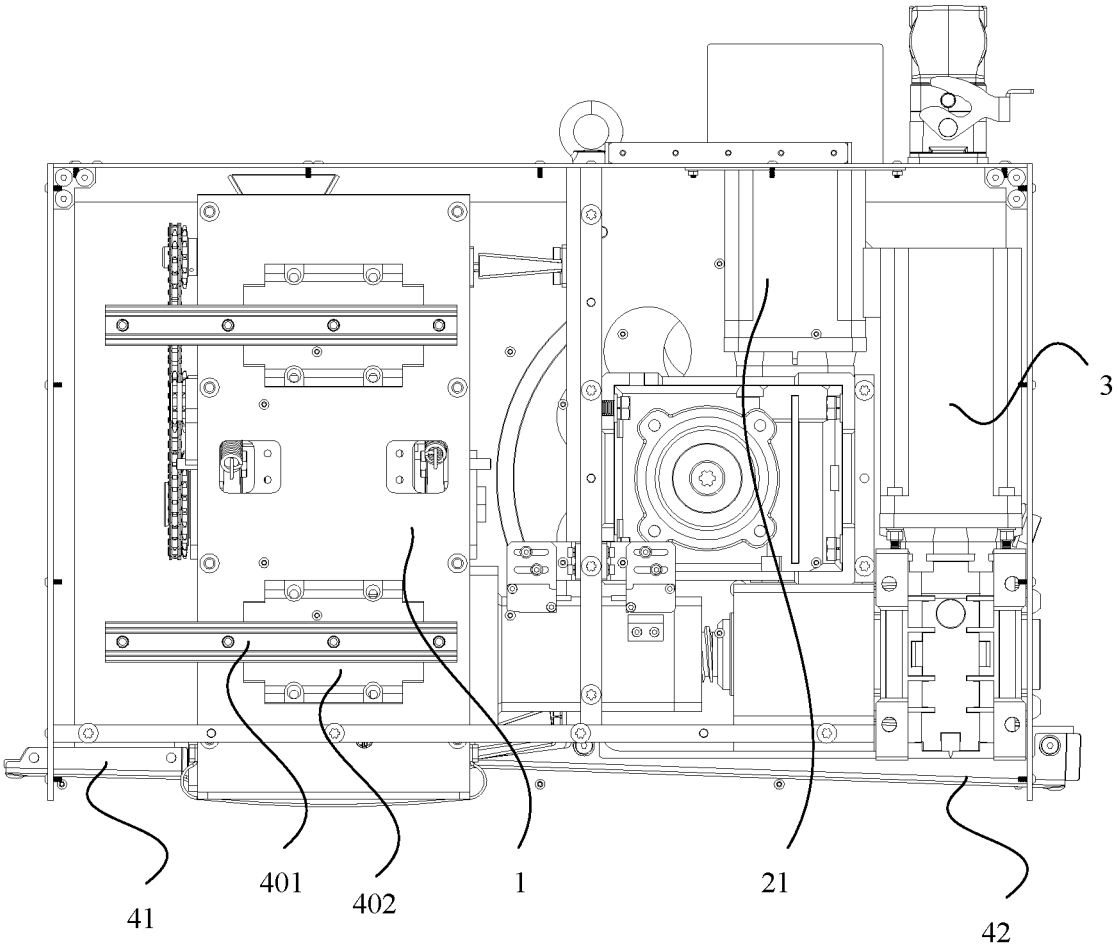
FIG. 6 is a schematic view showing the structure of a strapping machine head of the present invention with the back panel of the housing removed.

As shown in FIGS. 1-9, the present invention provides a strapping machine, which includes a strapping machine head, a strapping chute, and other accessory components of a conventional strapping machine. Wherein, a strapping tape 100 is fed into the strapping machine head and into the strapping chute such that the strapping tape 100 is wrapped around the goods loop, and then the strapping tape 100 is tensioned, welded, and cut by the strapping machine head to accomplish the baling process on the goods. Specific structural forms of the strapping chute and other ancillary components in the strapping machine may be referred to herein as configurations in conventional bailers and are not limited or repeated herein.

In order to apply a balanced tension force on the bale belt 100, the strapping machine head includes a sealing assembly 1, a belt feeding assembly 2, a driving assembly 3 and a mounting base 40. The belt feeding assembly 2 is used to drive the movement of the strapping tape 100 into the strapping machine head so that the strapping tape 100 can be transported out through the sealing assembly 1 into the strapping chute and finally transported again into the sealing assembly 1. The sealing assembly 1 may then weld and cut the bale belt 100, and to effect tightening of the bale belt 100, the driving assembly 3 moves the drive sealing assembly 1 such that the bale belt 100 enclosed outside the goods is tightened. Specific structural aspects of the sealing assembly 1, the belt feeding assembly 2 and the driving assembly 3 are described below.

The sealing assembly 1 includes a cutter 11 and a sealing element 12, the sealing element 12 is used for welding the strapping tape 100, and the cutter 11 is used for cutting the strapping tape 100; the sealing assembly 1 further includes a first clamping mechanism 13, a second clamping mechanism 14 and a third clamping mechanism 15, the first clamping mechanism 13, the second clamping mechanism 14 and the third clamping mechanism 15 are used for clamping the strapping tape 100; the sealing assembly 1 is slidably disposed on the mounting base 40. In particular, for the particular instance of cutter 11 and sealing element 12 in which sealing assembly 1 is configured, reference may be made to a structural design of the conventional strapping machine head, which is not repeated and limited herein. The second clamping mechanism 14, the cutter 11, the sealing element 12 and the third clamping mechanism 15 are sequentially disposed in a lower portion of the sealing assembly 1, and the first clamping mechanism 13 is disposed in an upper portion of the sealing assembly 1. The sealing assembly 1 is configured with three clamping mechanisms, and in the process of tightening the strapping tape 100, the strapping tape 100 is clamped by the three clamping mechanisms.

The belt feeding assembly 2 includes a first motor 21, a driving wheel 22 and a guide block 23, the guide block 23 is fixedly disposed on the mounting base 40, the driving wheel 22 is rotatably disposed on the mounting base 40 and an arc-shaped belt feeding channel 20 is formed between the driving wheel and the guide block 23, the first motor 21 is used to drive the driving wheel 22 to rotate. Specifically, for the belt feeding assembly 2, it is mainly used to drive the strapping tape 100 to move, the strapping tape 100 first passes through the first clamping mechanism 13 and enters the sealing assembly 1 through the belt feeding channel 20, and the strapping tape 100 is sequentially passing through the second clamping mechanism 14, the cutter 11, the sealing element 12 and the third clamping mechanism 15. The strapping tape 100 located in the belt feeding channel 20 can provide power for transmission through friction of the driving wheel 22, so that the strapping tape 100 can be output to the external strapping chute through the sealing assembly 1, and be guided to surround the goods through the strapping chute, and then returned to the sealing assembly 1, for the particular transmission of the strapping tape 100, reference may be made to the strapping tape 100 transport process, which is not repeated herein.

Driving assembly 3 is used to drive sealing assembly 1 toward or away from driving wheel 22. Specifically, since the first clamping mechanism 13, the second clamping mechanism 14 and the third clamping mechanism 15 are all disposed on the sealing assembly 1, after clamping two ends of the bale belt 100 by the first clamping mechanism 13 and the second clamping mechanism 14, the driving assembly 3 drives the sealing assembly 1 to move away from the belt feeding assembly 2. There are various forms of the physical representation of the driving assembly 3, for example: the driving assembly 3 is an electric push cylinder, the push rod of the electric push cylinder is connected to the sealing assembly 1; alternatively, the driving assembly 3 includes a drive motor, a gear and a rack, the gear is rotatably disposed on the mounting base 40, the rack is slidably mounted on the mounting base 40, the gear is cooperated with the rack, the drive motor is drivingly connected to the gear, and the rack is connected to the sealing assembly 1; the driving assembly includes a second drive motor, a screw and a nut, the nut is threadedly connected to the screw, the second drive motor is drivingly connected to the screw, the nut is connected to the sealing assembly.

Figure 7:
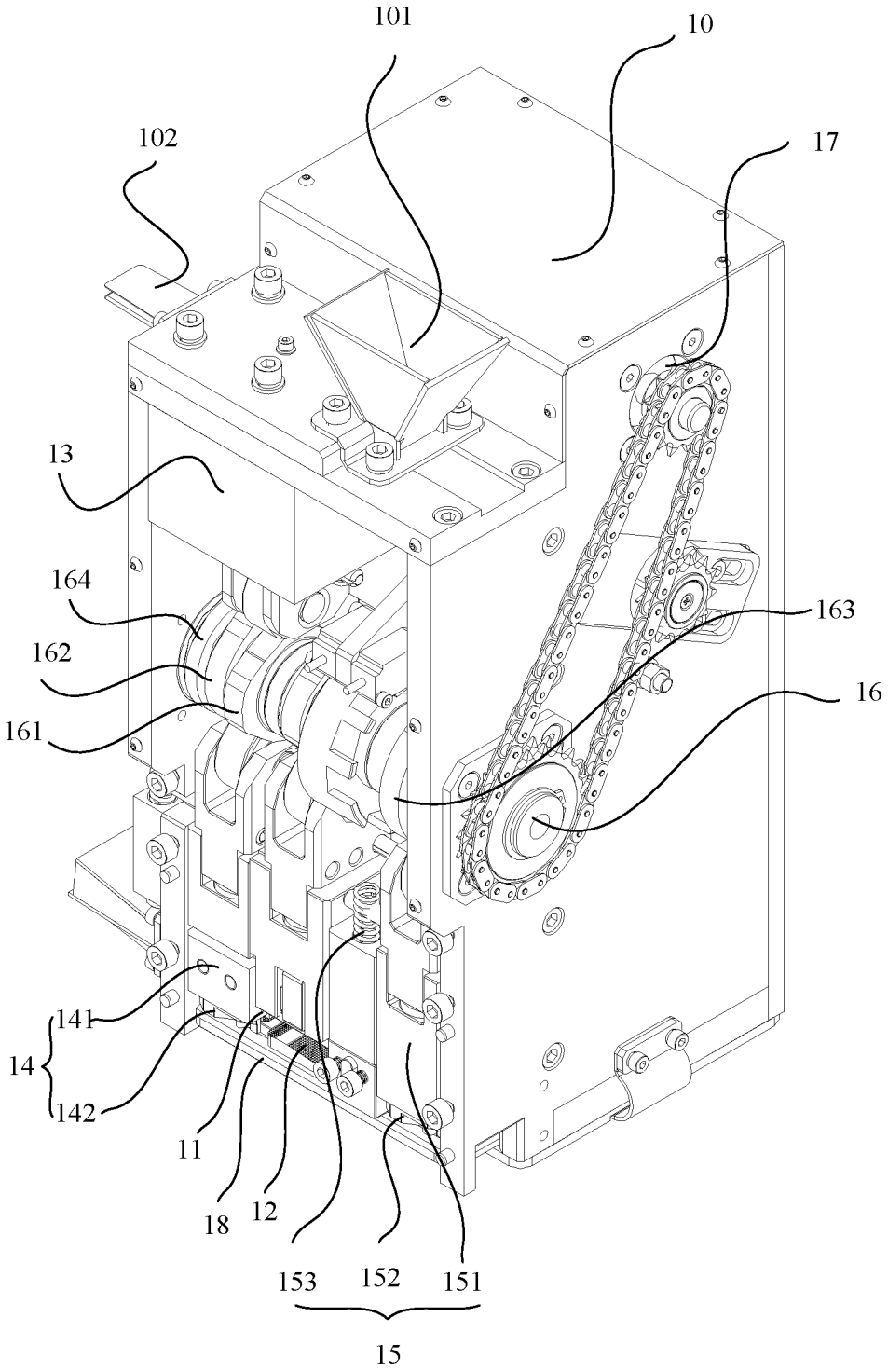
FIG. 7 is a schematic structural view of the sealing assembly in a strapping machine head of the present invention.
Figure 8:
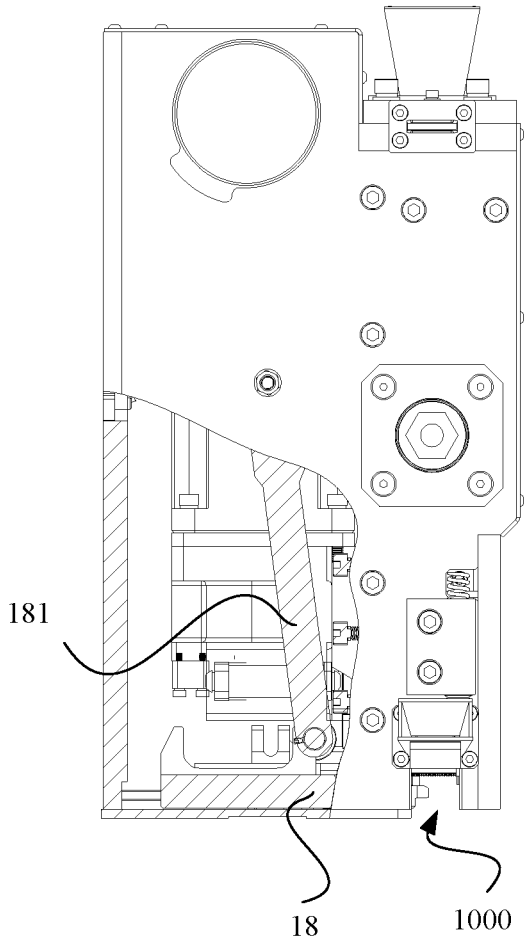
FIG. 8 is a partial cross-sectional view of a strapping machine head of the present invention.
Figure 9:
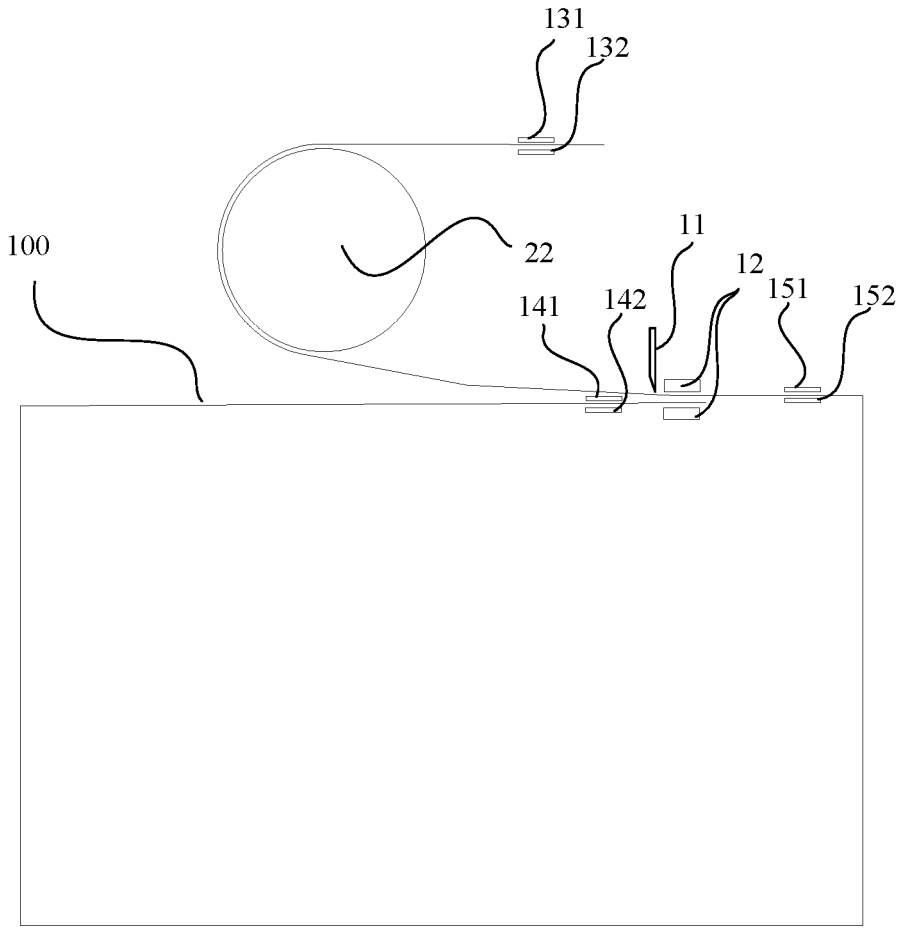
FIG. 9 is a schematic illustration of the use state of a strapping machine head of the present invention.

As shown in FIG. 7, the strapping tape 100 is clamped by the first clamping mechanism 13 and the second clamping mechanism 14, at the same time, the strapping tape 100 also wraps around the driving wheel 22, a pulley like structure is formed within the strapping tape 100, the first clamping mechanism 13, the second clamping mechanism 14 and the driving wheel 22. Since the first clamping mechanism 13 and the second clamping mechanism 14 are all mounted and fixed to the sealing assembly 1, under the driving action of the driving assembly 3, the first clamping mechanism 13 and the second clamping mechanism 14 move synchronously, the first clamping mechanism 13 and the second clamping mechanism 14 will pull the strapping tape 100 simultaneously and a tensioning distance between the two ends of the strapping tape 100 is the same, the strapping tape 100 is guided by the driving wheel 22, so that the first clamping mechanism 13 and the second clamping mechanism 14 applies the same pulling force to two ends of the strapping machine tape 100. In this way, it is possible to ensure that the forces on two ends of the strapping tape 100 are balanced and avoid the uneven forces on two ends of the strapping tape 100 causing different levels of strapping tightness on two sides of the goods. At the same time, because the ends of the strapping tape 100 are forcibly balanced, a more common material can be used to reduce the manufacturing cost of the strapping tape 100 to reduce the overall strapping cost.

In addition, during the conveying process of the strapping tape 100 through the belt feeding assembly 2, a free end of the strapping machine tape 100 is first fed into the sealing assembly 1 and transported through the strapping chute, and finally transported again into the sealing assembly 1, and at this time, two layers of strapping machine tape 100 will be formed at the sealing element 12 (for the specific conveying process, please refer to the conveying process of the strapping machine tape 100 of the strapping machine). After the tensioning operation of the strapping tape 100 is completed by the first clamping mechanism 13 and the second clamping mechanism 14, the strapping tape can be cut and welded. At this time, the third clamping mechanism 15 will clamp the strapping tape 100 in place of the first clamping mechanism 13, and at this time, the first clamping mechanism 13 releases the strapping tape 100, and the cutter 11 cuts the strapping tape 100 which is fed from the belt feeding assembly 2 to the sealing assembly 1. Then, welding process is performed by the sealing element 12 on the strapping tape 100 stacked on the front side of the third clamping mechanism 15 and the rear side of the second clamping mechanism 14, so that the two ends of the strapping tape 100 are welded together and hold the goods. Finally, the second clamping mechanism 14 and the third clamping mechanism 15 release the strapping tape 100 to complete the strapping operation. Further, the sealing assembly 1 includes a housing 10, a top of the housing 10 is provided with an inlet belt lead-in portion 101 and an outlet belt lead-out portion 102, the first clamping mechanism 13 is located between the inlet belt lead-in portion 101 and the outlet lead out portion 102, the outlet belt lead-out portion 102 is disposed opposite the inlet of the feeding channel 20. Specifically, the cutter 11, the sealing element 12, the first clamping mechanism 13 and the second clamping mechanism 14 in the sealing assembly 1 are all mounted in the housing 10, and the housing 10 is further provided with an inlet belt lead-in portion 101 and an outlet belt lead-out portion 102 to complete the lead-in and lead-out of the bale belt 100.

Wherein, in order to smoothly guide the strapping tape 100, the representation entities of the inlet belt lead-in portion 101 may be a pipe of a bell mouth structure or a funnel-shaped component. The representation entities of the outlet belt lead-out portion 102 may be a flat duckbill structure or a tapered tube structure, so that the strapping tape 100 can be accurately outputted and entered into the belt feeding channel 20. At the same time, the inlet of the belt feeding channel 20 is provided with an abutment portion 201 for inserting the outlet belt lead-out portion 102, and the abutment portion 201 is provided with a bell mouth structure, and the outlet belt lead-out portion 102 can be inserted into the abutment portion 201 during the process of conveying the strapping machine tape 100, so that the strapping machine tape 100 can smoothly enter the belt feeding channel 20.

In some embodiments, in order to achieve clamping of the strapping tape 100 by the first clamping mechanism 13, the second clamping mechanism 14 and the third clamping mechanism 15, the representation entities of the first clamping mechanism 13, the second clamping mechanism 14 and the third clamping mechanism 15 may have various structural forms. For example: the first clamping mechanism 13 includes a first telescopic mechanism provided in the housing 10 and two oppositely arranged first clamping blocks, the first telescopic mechanism is used to drive the two first clamping blocks toward and away from each other; the second clamping mechanism 14 includes a second telescopic mechanism provided in the housing 10 and two oppositely disposed second clamping blocks, the second telescopic mechanism is used to drive the two second clamping blocks toward and away from each other; the third clamping mechanism 15 includes a third telescopic mechanism provided in the housing 10 and two oppositely disposed third clamping blocks, the third telescopic mechanism is used to drive the two oppositely disposed third clamping blocks toward and away from each other and two oppositely disposed third clamping blocks. Taking the first clamping mechanism 13 as an example, the first telescopic mechanism may employ an electric push cylinder, wherein one of the first clamping blocks is stationary and the other of the first clamping blocks is movable, and the electric push cylinder drives the movable first clamping block toward and away from the fixed first clamping block to achieve the clamping operation of the strapping tape 100.

Preferably, in order to achieve a compact design and reduce manufacturing costs, the housing 10 is provided with a rotating shaft 16, the rotating shaft 16 is provided with a first cam 161, a second cam 162 and a third cam 163, the housing 10 is also provided with a second motor 17, the second motor 17 is drivingly connected with the rotating shaft 16; the first clamping mechanism 13 includes a first fixed block 131, a first sliding block 132 and a first return spring 133 arranged oppositely, the first fixed block 131 is fixedly disposed in the housing 10, the first sliding block 132 is slidably disposed in the housing 10 and is in contact with the first cam 161, the first return spring 133 is used to apply an elastic force to the first sliding block 132 to move in the direction of the first cam 161; the second clamping mechanism 14 includes a second fixed block 141, a second sliding block 142 and a second return spring (not shown) arranged oppositely, the second fixed block 141 is fixedly disposed in the housing 10, the second sliding block 142 is slidably disposed in the housing 10 and is in contact with the second cam 162, the second return spring is used to apply an elastic force to the second sliding block 142 to move in the direction of the second cam 162; the third clamping mechanism 15 includes a third fixed block 151, a third sliding block 152 and a third return spring 153 arranged oppositely, the third fixed block 151 is fixedly disposed in the housing 10 and is in contact with the third cam 162, the third return spring 153 is used to apply an elastic force to the third sliding block 152 to move in the direction of the third cam 163.

Specifically, taking the first clamping mechanism 13 as an example, the strapping tape 100 passes through the clamping area formed between the first fixed block 131 and the first sliding block 132, and when it is desired to clamp the strapping tape 100, the second motor 17 drives the rotating shaft 16 to rotate, and the rotating shaft 16 drives the first cam 161 to rotate, so as to drive the first sliding block 132 to move toward the first fixed block 131 by the first cam 161, and finally, the strapping tape 100 is clamped between the first fixed block 131 and the first sliding block 132. When it is desired to release the strapping tape 100, the second motor 17 rotates so that the smaller radius portion of the first cam 161 contacts the first slide block 132, and under the influence of the first return spring 133, the first slide block 132 away from the first stationary block 131. Since the two clamping mechanisms share the second motor 17 to provide power, on the one hand, the overall structure of the sealing assembly 1 is more compact, and on the other hand, the manufacturing cost can be effectively reduced. Compared with the conventional technique, in which the clamping jaws are respectively arranged in the two components to clamp the strapping tape, the first clamping mechanism 13 and the second clamping mechanism 14 for tightening the strapping tape are both arranged in the sealing component 1 and synchronously driven by the same second motor 17, which has better synchronization and reliability.

Wherein, in order to conveniently achieve the two layers of strapping tape 100 in sealing assembly 1, a belt passing channel 1411 is formed in second sliding block 141. The strapping tape 100 output from the belt feeding assembly 2 first enters the belt passing channel 1411 and then sequentially passes through the cutter 11, the sealing element 12, and a space between the third stationary block 151 and the third sliding block 152 in the third clamping mechanism 15 and is output from the sealing assembly 1, the strapping tape 100 is transported in the outer strapping chute and finally re-enters the sealing assembly 1. The strapping tape 100 output from the strapping chute passes through a space between the second sliding block 141 and the second fixed block 142 of the second clamping mechanism 14, and passes through the cutter 11 and the sealing element 12, and finally the end of the strapping tape 100 is located on the front side of the third clamping mechanism 15.

In a preferred embodiment, in order to facilitate the smooth release of the strapping tape 100 in the sealing assembly 1 after the strapping operation has been completed, a strip-shaped opening 1000 may be provided in the bottom of the housing 10 and a slidable mounting plate 18 may be provided in the bottom of the housing 10, the second mounting block 141 and the third mounting block 151 are fixedly mounted on the mounting plate 18, and the mounting plate is used for sliding the switch strip-shaped opening 1000. Specifically, in the actual use process, during the belt feeding and tensioning process, the mounting plate 18 covers the top of the strip-shaped opening, strip-shaped opening so that the strapping tape 100 is conveyed through the top of the mounting plate 18. After the strapping is completed, the strapping tape 100 needs to be removed from the sealing assembly 1, and at this time, the mounting plate 18 is moved so that the mounting plate 18 is far away the strip-shaped opening 1000. During the movement of the mounting plate 18, the strapping tape 100 will be disengaged from the mounting plate 18 and disengaged from the strip-shaped opening 1000. For the driving method of the mounting plate 18, the bottom portion of the mounting plate 18 within the housing 10 may be driven to slide by a separate driving component, for example: an electric push rod (not shown) is provided within the housing 10, and the electric push rod is connected to the mounting plate 18 to drive the mounting plate 18 to move. In order to reduce manufacturing costs and improve the degree of integration, a fourth cam 164 is provided on the rotating shaft 16, and the housing 10 is further provided with a rotatable swing arm 181, a lower end of the swing arm 181 is connected to the mounting plate 18, and an upper end of the swing arm 181 is connected to the fourth cam 164. The swing arm 181 is rotated by the fourth cam 164, so that the swing arm 181 drives the bottom of the mounting plate 18 to move back and forth. The lower end of the swing arm 181 is hingedly connected to the mounting plate 18, and the upper end of the swing arm 181 abuts against the surface of the fourth cam 164, a return spring is provided between the swing arm 181 and the housing 10, the return spring is used to achieve the automatic return of the swing arm 181 to cover the strip-shaped opening 1000.

In other embodiments, for the belt feeding assembly 2, in order to enable the driving wheel 22 to smoothly transport the strapping tape 100, the guide block 23 that cooperates with the driving wheel 22 adopts a split design to reduce the processing difficulty, specifically: the guide block 23 includes an upper guide block 231 and a lower guide block 232, the upper guide block 231 and the lower guide block 232 are respectively fixed on the mounting base 40, and the surfaces of the upper guide block 231 and the lower guide block 232 are matched with the driving wheel 22 are each arcuate surface. Specifically, the use of the upper guide block 231 and the lower guide block 232 arranged above and below to cooperate with the driving wheel 22 to form the belt feeding channel 20, which can effectively reduce the overall processing difficulty of the guide block 23 and facilitate the assembly of the device.

Further, the guide block 23 further includes an upper auxiliary guide block 2311 and a lower auxiliary guide block 2321, the upper auxiliary guide block 2311 is sandwiched between the upper guide block 231 and the driving wheel 22, the upper auxiliary guide block 2311 and the upper guide block 231 is forming an inlet of the belt feeding channel 20, the lower auxiliary guide block 2321 is sandwiched between the lower guide block 232 and the driving wheel 22, the lower auxiliary guide block 2321 and the lower guide block 232 is forming an outlet of the belt feeding channel 20. Specifically, since the driving wheel 22 has a circular structure, in order to make the inlet and outlet of the belt feeding channel 20 relatively align with the belt feeding position of the sealing assembly 1, the belt feeder formed between the upper auxiliary guide block 2311 and the upper guide block 231 The inlet of the channel 20 faces outlet belt lead-out portion 102, while the outlet of the tape feeding channel 20 formed between the lower auxiliary guide block 2321 and the lower guide block 232 faces the inlet belt lead-in portion (not labeled) of the sealing assembly 1.

Still further, an spacing region (not labeled) is formed between the upper guide block 231 and the lower guide block 232; the belt feeding assembly 2 further includes a pressing assembly 24, the pressing assembly 24 includes a wheel base 241, a pressing wheel 242 and a pressing spring 243, one end of the wheel base 241 is rotatably mounted on the mounting base 40, the pressing spring 243 is configured to apply an elastic force to the wheel base 241 to rotate in the direction of the driving wheel 22, the pressing wheel 242 is rotatably disposed on the wheel base 241, and the pressing wheel 242 is located in the spacing region and abuts on the driving wheel 22. Specifically, in order to enable the strapping tape 100 to be transported against the driving wheel 22, the strapping tape 100 is pressed against the driving wheel 22 by the pressing wheel 242 in the pressing assembly 24, so that the rotating driving wheel 22 effectively drives the strapping tape 100 to move smoothly, and during the conveying process of the strapping tape 100, the slippage of the driving wheel 22 relative to the strapping tape 100 can be reduced or avoided, so as to improve the reliability and efficiency of conveying.

Based on the above technical solutions, for the mounting base 40, a conventional base form can be used, the sealing assembly 1, the belt feeding assembly 2 and the driving assembly 3 are exposed and mounted on the mounting base 40, and optionally, the mounting base 40 is further provided with a housing to form an casing 4, so that the sealing assembly 1, the belt feeding assembly 2 and the driving assembly 3 are mounted in the casing 4, and each component is centrally mounted in the casing 4 to achieve an all-in-one design, and, for ease of practical use, an outlet chute 41 is provided on one side of the casing 4 for outputting the strapping tape 100, a return chute 42 is provided on another side of the casing 4 for introducing the strapping tape 100, the outlet chute 41 and the return chute 42 are respectively connected to the sealing assembly 1, the outlet chute 41 is used to introduce the strapping tape 100 output from the sealing assembly 1 to an external strapping chute, and the return chute 42 is used to reintroduce the strapping tape 100 conveyed by the strapping chute into the sealing assembly 1.

Specifically, in actual use, the strapping tape 100 needs to first enter the sealing assembly 1 and output from the sealing assembly 1 into the external strapping chute, and finally, the strapping tape 100 in the strapping chute needs to be return to the sealing assembly 1 again. When a strapping machine head needs to be repaired, the whole bale head can be disassembled from the strapping machine, and then a new strapping machine head can be directly replaced. For the newly replaced strapping machine head, it is only necessary to adjust the positions of the outlet chute 41 and the return chute 42 to align with the outer strapping chute, so that the time occupied by maintenance can be greatly shortened, the time required for separate disassembly and replacement of the sealing assembly 1 and the belt feeding assembly 2 for adjustment and matching can be avoided, and the time of production downtime due to maintenance can be reduced. Wherein, the strapping tape 100 output from the return chute 42 is located below the strapping tape 100 output from the belt feeding assembly 2 and into the sealing assembly 1 simultaneously.

An opening 43 is also provided in the casing 4, the strapping tape 100 into the casing 4 through the opening 43 and then into the sealing assembly 1 and the belt feeding assembly 2. For the specific mounting method of the outlet chute 41 and the return chute 42, the outlet chute 41 is mounted on the sealing assembly 1, the strapping tape output by the sealing assembly 1 enters the outlet chute 41; the return chute 42 can be mounted on the casing 4 and located under the belt feeding assembly 2, the strapping tape 100 into the return chute 42 and is directed therethrough into the sealing assembly 1. The strapping tape 100 conveyed from the feed belt feeding assembly 2 into the sealing assembly 1 is located above the strapping tape 100 conveyed into the sealing assembly 1 by the return chute 42.

In order to satisfy the sliding mounting of the sealing assembly 1, a guide rail 401 may be provided on the mounting base 40, a reciprocating sliding carriage 402 is provided on the guide rail 401, and the sealing assembly 1 is provided on the sliding carriage 402. Specifically, the mounting base 40 on the casing 4 can be connected to the sliding carriage 402 by means of bolts, so that when the driving assembly 3 drives the sealing assembly 1 to move, the sealing assembly 1 can move smoothly along the guide rail 401.

Wherein, regarding the manner in which the above-mentioned motor output power realizes the transmission connection, the manner of adding a reducer to the rotating shaft of the motor may be adopted, which will not be limited or described herein.

The invention claimed is:

1. A head for a strapping machine, the head comprising:

a mounting base;

a sealing assembly including a cutter and a sealing element, the sealing element is configured for welding a strapping tape, and the cutter configured for cutting the strapping tape, wherein the sealing assembly further comprises a first clamping mechanism, a second clamping mechanism, and a third clamping mechanism, the first clamping mechanism, the second clamping mechanism, and the third clamping mechanism configured for clamping the strapping tape, and wherein the sealing assembly is slidably disposed on the mounting base;

a belt feeding assembly including a first motor, a driving wheel and a guide block, wherein the guiding block is fixedly disposed on the mounting base, and the driving wheel is rotatably disposed on the mounting base and an arc-shaped belt feeding channel is formed between the driving wheel and the guide block, the first motor is used to drive the driving wheel to rotate;

a driving assembly for driving the sealing assembly close to or away from the driving wheel;

wherein the strapping tape first passes through the first clamping mechanism into the sealing assembly via the belt feeding channel, and the strapping tape is sequentially passed through the second clamping mechanism, the cutter, the sealing element and the third clamping mechanism;

wherein the sealing assembly comprises a housing, a top portion of the housing is provided with an inlet belt lead-in portion and an outlet belt lead-out portion, the first clamping mechanism is located between the inlet belt lead-in portion and the outlet belt lead-out portion, and the outlet belt-lead-out portion is disposed opposite an inlet port of the belt feeding channel;

a rotating shaft is disposed in the housing, a first cam, a second cam, and a third cam are disposed on the rotating shaft, and a second motor is disposed on the housing, and the second motor is drivingly connected to the rotating shaft;

the first clamping mechanism includes a first fixed block, a first sliding block, and a first return spring disposed oppositely, the first fixed block is fixedly disposed in the housing, the first sliding block is slidably disposed in the housing and in contact with the first cam, the first return spring is used to apply an elastic force on the first sliding block that moves toward a direction of the first cam;

the second clamping mechanism includes a second fixed block, a second sliding block, and a second return spring arranged oppositely, the second fixed block is fixedly disposed in the housing, the second sliding block is slidably disposed in the housing and in contact with the second cam, the second return spring is used to apply an elastic force on the second sliding block that moves toward a direction of the second cam; and the third clamping mechanism includes a third fixed block, a third sliding block, and a third return spring arranged oppositely, the third fixed block is fixedly disposed in the housing, the third sliding block is slidably disposed in the housing and in contact with the third cam, the third return spring is used to apply an elastic force on the third sliding block that moves toward a direction of the third cam.

2. The head for a strapping machine according to claim 1, wherein the inlet port of the belt feeding channel is provided with an abutment portion for inserting the outlet belt lead-out portion, and the abutment portion has a bell mouth structure.

3. The head for a strapping machine according to claim 1, wherein the guide block includes an upper guide block and a lower guide block, the upper guide block and the lower guide block are each fixedly mounted on the mounting base, and surfaces of the upper guide block and the lower guide block that cooperate with the driving wheel are each arcuate surface.

4. The head for a strapping machine according to claim 3, wherein a spacing region is formed between the upper guide block and the lower guide block; the belt feeding assembly further comprises a pressing assembly, the pressing assembly comprises a wheel base, a pressing wheel and a pressing spring, an end of the wheel base is rotatably mounted on the mounting base, the pressing spring is used to apply an elastic force to the wheel base that rotates in a direction of the driving wheel, the pressing wheel is rotatably disposed on the wheel base, and the pressing wheel is located in the spacing region and against the driving wheel.

5. The head for a strapping machine according to claim 1, wherein a guide rail is provided on the mounting base, a reciprocating sliding carriage is provided on the guide rail, the sealing assembly is disposed on the sliding carriage.

6. A strapping machine, comprising a head for strapping a material, the head comprising:

a mounting base;

a sealing assembly including a cutter and a sealing element, the sealing element is configured for welding a strapping tape, and the cutter configured for cutting the strapping tape, wherein the sealing assembly further comprises a first clamping mechanism, a second clamping mechanism, and a third clamping mechanism, the first clamping mechanism, the second clamping mechanism, and the third clamping mechanism configured for clamping the strapping tape, and wherein the sealing assembly is slidably disposed on the mounting base;

a belt feeding assembly including a first motor, a driving wheel and a guide block, wherein the guiding block is fixedly disposed on the mounting base, and the driving wheel is rotatably disposed on the mounting base and an arc-shaped belt feeding channel is formed between the driving wheel and the guide block, the first motor is used to drive the driving wheel to rotate:

a driving assembly for driving the sealing assembly close to or away from the driving wheel;

wherein the strapping tape first passes through the first clamping mechanism into the sealing assembly via the belt feeding channel, and the strapping tape is sequentially passed through the second clamping mechanism, the cutter, the sealing element and the third clamping mechanism;

wherein the sealing assembly comprises a housing, a top portion of the housing is provided with an inlet belt lead-in portion and an outlet belt lead-out portion, the first clamping mechanism is located between the inlet belt lead-in portion and the outlet belt lead-out portion, and the outlet belt-lead-out portion is disposed opposite an inlet port of the belt feeding channel:

a rotating shaft is disposed in the housing, a first cam, a second cam, and a third cam are disposed on the rotating shaft, and a second motor is disposed on the housing, and the second motor is drivingly connected to the rotating shaft;

the first clamping mechanism includes a first fixed block, a first sliding block, and a first return spring disposed oppositely, the first fixed block is fixedly disposed in the housing, the first sliding block is slidably disposed in the housing and in contact with the first cam, the first return spring is used to apply an elastic force on the first sliding block that moves toward a direction of the first cam;

the second clamping mechanism includes a second fixed block, a second sliding block, and a second return spring arranged oppositely, the second fixed block is fixedly disposed in the housing, the second sliding block is slidably disposed in the housing and in contact with the second cam, the second return spring is used to apply an elastic force on the second sliding block that moves toward a direction of the second cam; and the third clamping mechanism includes a third fixed block, a third sliding block, and a third return spring arranged oppositely, the third fixed block is fixedly disposed in the housing, the third sliding block is slidably disposed in the housing and in contact with the third cam, the third return spring is used to apply an elastic force on the third sliding block that moves toward a direction of the third cam.

* * * * *